US010633815B2

(12) United States Patent
Vartdal et al.

(10) Patent No.: US 10,633,815 B2
(45) Date of Patent: Apr. 28, 2020

(54) SEA BED TERMINAL FOR OFFSHORE ACTIVITIES

(71) Applicant: GraviFloat AS, Bergen (NO)

(72) Inventors: Harald Vartdal, Slemmestad (NO); Tore Roysheim, Lommedalen (NO); Geir L. Kjersem, Bones (NO)

(73) Assignee: Gravifloat AS, Bergen (NO)

( * ) Notice: Subject to any disclaimer, the term of this patent is extended or adjusted under 35 U.S.C. 154(b) by 0 days.

(21) Appl. No.: 15/577,968

(22) PCT Filed: Sep. 8, 2015

(86) PCT No.: PCT/NO2015/050156
§ 371 (c)(1),
(2) Date: Nov. 29, 2017

(87) PCT Pub. No.: WO2016/085347
PCT Pub. Date: Jun. 2, 2016

(65) Prior Publication Data

US 2018/0163359 A1 Jun. 14, 2018

(30) Foreign Application Priority Data

Nov. 27, 2014 (NO) ..... 20141426

(51) Int. Cl.
*E02B 17/02* (2006.01)
*B63B 35/00* (2020.01)
(Continued)

(52) U.S. Cl.
CPC ..... *E02B 17/025* (2013.01); *B63B 35/003* (2013.01); *B63C 1/02* (2013.01);
(Continued)

(58) Field of Classification Search
CPC ... B63B 35/285; B63B 43/06; B63B 2738/10; B63C 1/00; B63C 1/02; B63C 1/04;
(Continued)

(56) References Cited

U.S. PATENT DOCUMENTS 1,335,497 A * 3/1920 Hamilton ..... B63B 1/02 405/3
3,081,600 A * 3/1963 Davidon ..... E02B 17/025 405/208
(Continued)

FOREIGN PATENT DOCUMENTS

FR 2 894 646 A1 6/2007
GB 1369915 10/1974
(Continued)

OTHER PUBLICATIONS

International Preliminary Report on Patentability and Written Opinion of PCT/NO2015/050156 dated May 30, 2017.
(Continued)

*Primary Examiner* — Benjamin F Fiorello
*Assistant Examiner* — Edwin J Toledo-Duran
(74) *Attorney, Agent, or Firm* — Cesari and McKenna, LLP

(57) ABSTRACT

A shallow water seabed terminal for storing and loading or unloading hydrocarbons, such as LNG, oil or gas, includes a removable floatable module and a removable seabed substructure intended to be supported by a seabed. The floatable module is releasably fixed to the seabed substructure so that a harbour terminal is formed. The seabed substructure includes a base structure provided with buoyancy devices, a wall structure extending upwardly from the base structure and arranged along at least a part of the periphery of the base structure. The base structure is also provided with an opening in the wall structure for allowing
(Continued)

the floatable module to be berthed in and supported by the seabed substructure. The base structure is provided with a submerged beam or base slab structure which extends laterally out from the vertical wall structure and is configured to support the floatable module.

26 Claims, 8 Drawing Sheets

(51) Int. Cl.
*E02D 27/52* (2006.01)
*E02D 23/02* (2006.01)
*B63C 1/02* (2006.01)

(52) U.S. Cl.
CPC ..... *E02D 23/02* (2013.01); *E02D 27/52* (2013.01); *E02D 27/525* (2013.01); *E02D 2600/30* (2013.01); *F17C 2270/0123* (2013.01)

(58) Field of Classification Search
CPC .... B63C 1/06; B63C 3/08; B63C 5/04; B63G 2008/425; B65D 88/78; E02B 17/02; E02B 2017/0039; E02B 2017/0082; E02B 2017/0086; F17C 3/005
USPC ..... 405/4, 7, 203–205, 210; 62/50.2, 53.1; 220/560, 560.11; 114/45, 256, 257
See application file for complete search history.

(56) References Cited

U.S. PATENT DOCUMENTS 3,472,033 A * 10/1969 Brown ..... B63B 35/44 405/210
3,688,719 A * 9/1972 Amirikian ..... B63B 9/00 114/267
3,710,582 A * 1/1973 Hills ..... B65D 88/78 405/210
3,766,583 A * 10/1973 Phelps ..... B63B 35/4413 405/203
3,777,497 A * 12/1973 Edwards ..... B65D 88/78 405/210
3,958,426 A 5/1976 Heien
4,140,426 A * 2/1979 Knox ..... E02B 17/0008 405/225
4,200,411 A * 4/1980 Brown ..... B65D 88/78 114/257
4,217,848 A 8/1980 Meyer-Haake
4,762,442 A * 8/1988 Thomas ..... E02B 17/021 405/196
5,522,680 A * 6/1996 Hoss ..... E02B 17/00 405/209
9,664,338 B2 * 5/2017 Hata ..... F17C 3/025
2005/0139595 A1 6/2005 Pepin-Lehalleur et al.
2009/0324341 A1 * 12/2009 Grinberg ..... E02D 23/02 405/205
2011/0158747 A1 * 6/2011 Ohkubo ..... H02G 9/025 405/157
2012/0020742 A1 * 1/2012 Mahmoud ..... B65D 88/78 405/224
2012/0321387 A1 * 12/2012 del Campo y Ruiz de Almodovar ..... E02C 5/02 405/1
2017/0183835 A1 * 6/2017 Lee ..... E02B 17/02
2019/0127939 A1 * 5/2019 Kjersem ..... E02B 17/027

FOREIGN PATENT DOCUMENTS

GB 2 345 716 A 7/2000
NO 20093602 A1 12/2010
WO WO 2006/041312 A1 4/2006
WO WO 2013/002648 1/2013

OTHER PUBLICATIONS

International Search Report of PCT/NO2015/050156 dated Mar. 7, 2016.
Extended European Search Report in corresponding Application No. EP 15 86 2483, dated Oct. 12, 2018.

* cited by examiner

SEA BED TERMINAL FOR OFFSHORE ACTIVITIES

CROSS-REFERENCE TO RELATED APPLICATIONS

This application is the National Stage of International Application No. PCT/N02015/050156, filed Sep. 8, 2015, which claims the benefit of priority of Norwegian Patent Application No. 20141426, filed Nov. 27, 2014, the contents of both being incorporated by reference in their entirety for all purposes.

THE TECHNICAL FIELD OF THE INVENTION

The present invention relates to a seabed terminal for storing and loading or unloading hydrocarbons, such as LNG, oil or gas, suitable for use in shallow waters with soft or muddy seabed soil conditions, comprising a floatable, removable storage module, and a removable seabed substructure intended to be supported by a seabed, the floatable module being releasably fixed to the seabed substructure so that a harbour terminal is formed, the seabed substructure comprises a base structure provided with buoyancy devices, an upwards extending wall structure extending up from the base structure and arranged along at least a part of the periphery of the base structure, the base structure also being provided with an opening in the side wall structure for allowing the floatable module, to be berthed in and supported by the seabed substructure, as further specified in the preamble of the independent claims.

BACKGROUND OF THE INVENTION

Harbour sites for LNG or large oil tankers are considered to be very hazardous. Therefore, it is not advantageous to place the sites in the vicinity of populated areas. At the same time, the largest number of consumers of LNG is found in densely populated countries. A number of solutions have therefore been suggested to place LNG storage installations at sea.

Further, to transfer LNG, articulated arms or hoses that are well insulated and flexible are often used. The hoses are often in fact very rigid and very inflexible. The articulated arms move normally in one plane only and do not tolerate sideways movements. This requires that a LNG vessel must properly be moored in protected harbours both during loading or unloading operations, lying leeward of the prevailing direction of wind and/or waves.

It has previously been proposed to provide harbour sites for LNG loading at sea that either float or are placed, resting on the ocean bottom. The floating sites have the problem in common that the transfer of LNG between vessel and storage installation takes place between two floating, movable bodies, moving more or less independent of each other. The dynamics put great demands on equipment and safety if the loading takes place side by side.

A major problem of storage structures for liquids resting directly on the sea bed by gravity (GBS=Gravity Based Structure), especially in shallow waters, is that a GBS requires large volumes of fixed ballast to secure positive ground pressure at all times,—also in extreme conditions with e.g. storm surges. It is well known that storm surges mostly appear in shallow waters near land, e.g. in connection with tropical cyclones, where water levels near shore may temporarily increase by up to 8-9 meters. This will expose huge uplift forces onto a GBS with liquids storage with large water plane area at sea level and being located near shore. The additional fixed ballast volumes to counteract such temporary uplift forces will necessitate significant increase of the GBS volume and weight to secure positive bottom pressure at all times, but also to secure additional buoyancy during float-in, submergence and installation of the GBS onto the seabed. Such increase in volume will again result further increase of uplift forces, necessitating additional ballast volumes for both sea water ballast and fixed ballast,—representing a negative design effect spiral which will be make a GBS solution very costly.

It is also known that GBS solutions may not be feasible or in best cases will be very expensive for use in soft and unconsolidated seabed soils, such as found in river deltas. For such reasons the GBS may be equipped with suction skirts, but the mere size and vertical height of such skirt solutions may represent prohibitively expensive foundation solutions, having to date made floating storage bodies the only viable solution in areas with such soil conditions.

An alternative is to transfer LNG between the aft and bow of the two floating bodies, but this is considerably more difficult than corresponding, prior art loading operations for oil, and the method places great demands on the equipment. If in addition these vessels are allowed to rotate, the storage vessel for LNG must be equipped with a complex underwater swivel system for LNG.

To reduce the problems associated with the dynamics of the floating bodies during loading operations, it has been proposed to install large, rectangular steel or concrete structures on the seabed, functioning as artificial harbours, where a continuous steel or concrete wall is intended to form a protection for incoming waves. Typical depths of water proposed are 8-30 metres. This type of large constructions are intended to be built away from populated areas and at the same time functioning as a breakwater for the LNG ships during loading and unloading operations.

The problem can be reduced by moving the ship over onto the leeward side of the harbour construction, but calculations and basin experiments have shown that the harbour construction which forms a continuous barrier must be built to be very large if one is to obtain a significant shielding effect when waves and swells come during one period from a particularly unfavourable angle. This is due to the well known effect that ocean waves will be bent around both sides of such a construction and a focal point will arise some distance behind the leeward side where the bent waves meet. At this focal point, the height of the waves can actually be higher than the incoming waves.

A large harbour construction placed on the ocean bottom, intended to act as a shield from the waves, will therefore be very costly. Different forms for such types of harbour sites for LNG built in concrete for shielding vessels from the waves during loading operations have been suggested. One suggested shape is, for example, to build the construction as a horseshoe and let the LNG vessels load/unload inside this. This will reduce the dynamics considerably, but the harbour site will be even more costly than a harbour site in the shape of a rectangle.

GB 1369915 describes a harbour site comprising a number of units that are afloat or sunk and otherwise constructed for placement on the seabed. Each unit comprises a base, load-carrying structure and moveable wave-breaking elements that can be moved if required.

U.S. Pat. No. 3,958,426 describe a harbour site comprising a number of units placed apart on the seabed, so that at least one straight mooring location is formed. The units are provided with fenders and wave dampening devices.

Applicants own publication WO 2006/041312 discloses a harbour plant for storage, loading and unloading hydrocarbons such as LNG at sea, the whole content of which hereby being included by the reference. The harbour comprises three units built from steel or concrete, placed on the seabed. The units are placed in sidewise relation in-line. The harbour is configured to dampen the waves, the vessel being intended to lie on the leeward side of the mooring.

Applicants own publication WO 2013/002648 discloses a harbour plant for storage, loading and unloading of hydrocarbon products at sea, comprising a number of units being mutually placed on the seabed so that a harbour plant is formed. The units are placed independently at a given distance apart in sideways direction and having a front surface along which a vessel is intended to be moored, forming passage(s) for parts of the waves, and being configured to dampen a part of the incoming waves while allowing other parts of the waves and current to pass through the harbour plant.

US 2005/139595 describes a plant storage and loading LNG, consisting of a seabed structure resting on a seabed, the seabed structure having a base slab resting on the seabed and three upwards extending walls. The seabed structure has an opening, allowing a floating module to be manoeuvred into position inside the seabed structure and ballasted to rest on the base slab.

FR 2894646 describes a gravity based structure resting on the seabed due to its own weight and provided with downwards projecting and open skirts, pressed down into the seabed. The gravity based structure has a U-shaped form, with vertical walls extending upwards from a submerged bottom slab, provided with buoyancy chamber, functioning as weight for providing the required weight. One embodiment of the gravity based structure may also be provided with piles extending downwards through the vertical walls and into the supporting soil, the piles being terminated at the top of the walls above sea level.

However, these harbour plants for storage can be large in scale, complex and expensive. They take a long time to build and they have limited variation with respect to mobility and other applications. Due to dependencies of deep skirts to enable foundation, problems may also be experienced during installation, in particular in shallow waters with muddy or soft seabed. In addition, the density, composition, consolidation and topography of seabed soil may vary significantly for one seabed location to another. For example, the soil in river mouths will often be dominated by soft, muddy soil with a kind of yoghurt texture, while other seabed areas may be influenced or overlapped by hard sandstone, limestone or ancient volcanic rock. This will have direct impact on the load bearing capacity of the seabed soil, and hence the possibility to find a predictable and reliable foundation solution for a seabed structure which shall be resting onto the seabed.

Hence, there exists a requirement for cost-effective, versatile and flexible harbour plant systems that can store different oil related products and bunkering, and are easy to build, maintain and repair, and which can be standardized as far as possible for fabrications and cost reasons, and which can easily be deployed in offshore or near shore locations with any type of seabed soil.

SUMMARY OF THE INVENTION

The invention relates to a shallow water seabed terminal for LNG, oil products and bunkering, comprising at least one removable seabed substructure being placed and supported by piles on a seabed so that a stable harbour foundation is formed. A storage module is removable arranged on top of the substructure, forming a seabed unit, and at least one seabed unit constituting a seabed terminal.

Another object of the present invention is to provide s seabed terminal designed in such way that the terminal that does not require use of downwards protruding open skirts in order to secure stable founding on a seabed site, let alone a need for a bottom surface of the seabed substructure to partly or completely be in contact with the seabed. In fact the seabed structure may be supported completely by and rest on the piles used.

The invention relates also to a method for establishing an assembled seabed terminal, a mooring configuration for the seabed substructure and a method to introduce a floating module to the seabed substructure.

In the following, the common designation of LNG (Liquefied Natural Gas) is used for natural gas that is cooled down to a liquid state. It is common to cool methane to about −161 degrees Celsius, but the invention is also applicable to other types of petroleum products, such as chilled gases such as ethane, methane, propane and butane. In addition, the invention can be used for storage, loading and unloading of oil and oil products.

An object of the present invention is to provide a versatile shallow water seabed terminal with storage units and a method for establishing such seabed terminal.

Another object of the invention is to provide a seabed terminal that is designed for transferring very large vertical loads onto the seabed soil, caused by large weights of liquids stored inside the storage module without allowing any relative motions between the terminal and the supporting structure and any relative motions between the seabed and the terminal.

A further object of the present invention is to provide a shallow water seabed terminal which is flexible, cost effective and easy to establish in most types of seabed soil conditions.

A still further object of the present invention is to provide a shallow water seabed terminal easy to convert to store different oil related products and bunkering.

Yet another object of the present invention is to provide a shallow water seabed terminal that is scalable in that it can easily be expanded or reduced in size to the required extent.

Another object of the invention is to provide a near shore storage system which may, when required, also be located in extremely soft and muddy soil as found in river deltas and seabed areas of unconsolidated soil where gravity based structures cannot be installed or will be prohibitively expensive.

An additional object of the invention is that it may be given the structural capacity to resist large buoyancy uplift forces during extreme storm surges without any major volumetric modifications of its loading bearing structure.

It is also an object of the invention to provide a flexible and bottom located seabed terminal for LNG, oil products and bunkering at sea which can be built as several smaller units, where each unit may be lowered down onto the seabed individually, supported by means of piling, so that all the units finally form a seabed terminal with mooring points in a desired direction, alternatively in several different directions.

Yet another object of the invention is to enable building of each of the units of the seabed terminal at reasonable price and efficiently and as complete as possible at a traditional construction site, preferably at a dockyard with the use of a dry dock. Thereby, the costly finishing work at sea will be minimised. After final outfitting at the building site, each of the units is brought or towed to the installation location, finally to be lowered down with the use of known techniques.

It is also an object of the invention to ensure safe transfer of large vertical loads into the seabed, generated by storing large volumes of liquids above sea level.

It is also an object of the present invention to provide a seabed terminal comprising a seabed substructure and a storage module specially designed to adapt each to other, and to simplify the berthing of the storage module in a time and cost effective way.

It is also an object of the invention to provide a quick and safe installation of the storage module with topside equipment.

The objects of the present invention are achieved by a shallow seabed terminal and a method for establishing such seabed terminal as further defined by the independent claims. Embodiments, alternatives and variants of the invention are defined by the dependent claims.

An essential feature of the present invention is that the base structure is provided at least with a submerged beam or base slab extending laterally out from the vertical wall structure and more or less also extending along the circumference of the base structure, configured to support the floatable, removable module, the beam or slab being provided with sleeves or ducts extending through the submerged beam or slab configured to receive the piles to be driven down into the seabed soil. The seabed substructure may also be provided with a bottom slab covering the total footprint of the base structure or the seabed structure may be provided with a laterally extending beam, extending only a limited distance out from vertical wall structure, forming a submerged surface for supporting the floatable module.

According to one embodiment the pile head is intended to be terminated below sea level, preferably flush with an upper surface of the beam or slab. Moreover, the sleeves or ducts may form an angle $\alpha$ with the vertical, securing piles in an inclined position when piled.

The wall structure may form an integrated part of the base structure, forming a seabed substructure unit and may be provided with means for ballasting. At least parts of the wall structure extend above the water surface.

According to one embodiment the seabed substructure may also be provided with ducts or sleeves for piling through the wall structure, such ducts or sleeves extending from the top of the wall structure through the bottom of the wall structure. Moreover, the seabed substructure may be provided with an opening in the wall structure for berthing the floatable module that may be closed by means of a closing mechanism, forming a closed wall structure within periphery of the base structure. According to one embodiment, the ducts or sleeves may be provided with sealing devices at the lower end, preventing grout to escape downwards.

Moreover, the inner surface of the ducts or sleeves is provided with spacers, preferably at the upper and lower end, configured to prevent the pile to come into direct contact with the inner duct or sleeve wall, thereby establishing an annulus for filling of grout.

The inner surface of the ducts or sleeves may be provided with a number of shear providing devices, securing proper shear and adhesion between the inner wall surface of the ducts or sleeves and the external wall surface of the pile. According to one embodiment, the base substructure may be divided into the same number of bulkheads as the storage module and that the vertical walls of the bulkheads forms a structural beam so that vertical forces of the storage module are transferred directly into the structural beams of the base structure, and the floating module may be locked to the base structure by a mechanical locking device or by e.g. welding shear force plates to the seabed substructure.

According to the invention, at least one removable seabed substructure is being placed and supported by piles extending into the seabed, so that a stable harbour foundation is formed. The seabed substructure comprises a base structure provided with buoyancy devices and an upward extending wall structure also provided with buoyancy devices. The wall structure is arranged along at least a part of the periphery of the base structure and comprises at least one opening in the wall structure for introducing a floatable storage module. The floatable module is removable arranged on top of the base structure within the wall structure, together forming an offshore unit supported by the seabed at least by means of piling.

According to a preferred embodiment of the invention, the wall structure is an integrated part of the base structure forming a seawater substructure unit. The wall structure of the seabed substructure is above sea level (but the wall structure can also be below the sea level). Some of the advantages of having part of the seabed substructure above water, as shown in the drawings, are:

a) The water plane are facilitates and reduces uncertainty around installation of the seabed substructure.
b) The part of seabed structure will facilitate and simplify the float-in and installation of the storage module.
c) Piling machinery may be placed on the seabed substructure above water level, which reduces cost and time.
d) The seabed substructure above water level will represent an added protection against ship collision.
e) Some equipment, e.g. cargo loading arms may in some cases be installed onto the seabed substructure and hence a bit away from the storage module.

According to one embodiment of the invention the seabed substructure has means for piling through the base structure possibly through the wall structure extending from the top of the wall structure through the bottom of the wall structure. The cross sectional view of the seabed substructure has different shape including round, square, rectangular, oval or even polygonal. The seabed substructure is made from concrete and/or steel.

According to one embodiment of the invention, the seabed substructure is a jacket frame structure.

According to one preferred embodiment of the invention, the seabed substructure is made from concrete with a rectangular shape, prefabricated with bulkheads in the base structure equivalent to the bulkheads in the storage module. Further, the seabed substructure is a prefabricated module floating on the water surface and has means for ballasting. The substructure is being placed and supported by means of piling on a seabed and possibly, also having means for piling along the wall structure extending at least through the bottom base structure. Alternatively, piles may be driven also through the upwards extending wall structure and the base structure of the seabed substructure.

According to one embodiment of the invention, the storage module is made from steel with similar cross sectional shape as the substructure like round, square, rectangular, oval or even polygonal. Advantageously the storage module has the same shape as the seabed substructure.

According to the invention, a floating storage module is arranged on top of the base structure within the wall structure and has means for ballasting. The storage module is a versatile module for storing LNG, LPG, Oil products of other bunkering, and contains at least one bulkhead. Further, the base structure is divided into the same number of bulkheads as the storage module, and that the vertical walls of the bulkheads forms a structural beam so that vertical forces of the storage module are transferred directly into the structural beams of the base structure and directly into the vertical piles which subsequently shall transfer large loads into the soil.

An important advantage of using the piles according to the present invention is that the piles may take both tension and compression, and at the same time in an efficient and cost effective manner allow for pile length of varying lengths as dimensions. The number, positions and dimensions of the ducts or sleeves may be configured in such way that extra, unused ducts or sleeves are provided in case further piling is required at a later stage.

The vertical loads induced by a large storage module may in some cases be enormous and a load transfer system securing safe vertical load transfer is mandatory to ensure safe and reliable operations. As an example a 160,000 m3 storage tank for crude oil will create a nominal, vertical load of 145,000 tonnes. Assuming a module foot print of e.g. 5,000 $m^2$ for such a module, the vertical loads onto the subsea structure and the seabed will be about 30 tonnes/$m^2$, plus safety factors. A safe vertical load transfer of such large vertical forces may according to the invention be secured by locating a number of the piles in the substructure underneath the storage module. According to the present invention such large vertical load transfers will be possible in almost any type of soils, as a piling system can be adapted to various soil types,—from very soft to dense soil.

A great advantage of the invention is that the piles of the substructure can also be designed for tensions to absorb uplift buoyancy forces. This feature will facilitate installation in extremely soft soils, such as river deltas, where the soil has limited vertical, downward holding capacity.

Moreover, due to the bottom slab configuration used covering more or less the entire footprint of the base structure a large degree of freedom is achieved with respect to total available number of piles feasibly to be used and the distances between neighbouring piles and positions of such number of piles. This may in particular be of importance in areas having poor or soft soil conditions and/or where extreme environmental loads and impacts may occur, such as large waves and storm surges.

In addition this feature of the piled foundation is also very useful when the storage system according to the invention is installed in shallow cyclone and storm surge exposed areas, where water levels in extreme 100 years cases may rise as much as 8-9 meter above normal sea level. For such cases the foundation piles may be designed to take a large portion of the uplift buoyancy forces, while other parts of these extreme, temporary uplift forces may be counteracted by active water ballasting of the storage module. In order to have an efficient transfer of large vertical structural forces, it is also an advantage that the main structural beams of the base structure and the storage module has mirrored structural interfaces. This means that vertical forces from the bulkheads storage module are preferably transferred directly into the main structural beams of the base structure.

The storage module is prefabricated and form fitted into the seabed substructure within the wall structure at the periphery of the base structure. The storage module is resting by its structural weight and water ballast on the base structure due to gravity. In addition the storage module may be locked, either mechanically (by existing techniques) or by e.g. welding shear force plates to the seabed substructure, in order to counteract any extreme, environmentally caused uplift forces on the storage module due to extreme tidal water, storm floods or tsunamis.

According to one embodiment of the invention, a seabed substructure mated with a storage module constituting a seabed unit, and at least one seabed unit constituting a seabed terminal.

According to another embodiment, the seabed units may be arranged so that two or more mooring points are formed, and where said mooring points form an angle in relation to each other, such as 90 degrees.

The seabed units may be provided with means for protecting the units from damages caused by collision, said means comprising elements projecting out from surfaces facing vessels, said means also preferably serving as anchoring points for a vessel intended to be moored along the seabed terminal and also preferably contribute to a wave breaking effect. The means for collision protection may be configured to extend down through waterline when in installed position.

The height of the mooring platform should be arranged above the sea level, at a low, but safe height, providing flexibility for mooring a wide range of different sized vessels.

The key area for the invention would be to have a quick and safe installation of the storage module with topside equipment. This is the costly part (90-95%) of the entire installation. By having a pre-installed base foundation, which is stabilized at least by means of piles and leveled in advance to the seabed, then the installation of the storage module can take place within a few hours.

According to the present invention, a method to arrange a seabed terminal is also provided. The method comprises the following steps:

at least one floating prefabricated substructure is towed at site and ballasted to the seabed forming a seabed foundation, the seabed substructure resting on stably on and being supported by means of piling through the base and possibly the wall structure, at least one prefabricated floating storage module is also towed to the site, and guided into the substructure through an opening in the wall structure at the periphery of the base structure and ballasted onto the base structure and mated.

It is an advantage of the present invention to arrange the seabed units in a way that waves are dampened efficiently by breaking and cancellation effects. The seabed units according to the invention forming the seabed terminal are placed apart at a required distance. The distance between the units is decided by the wave frequencies intended to be dampened and the frequencies allowed passing between the units. This distance can be calculated with known methods or be found by means of basic experiments.

In addition, it is a great advantage construction wise and economically that the seabed terminal is fabricated in smaller units. Thus, several workshops can compete for the construction that will, to a large extent, be able to be fabricated in traditional shipyards. In addition, the installation will be much less hazardous.

A further advantage according to the present invention is that the seabed substructure constituting the seabed unit for LNG according to the invention can be lowered down to the ocean bottom, be removed, be moved and be replaced to form new individual configurations as required using known techniques.

The present invention offers the possibility of introducing different types of means at a seabed terminal for LNG in a very cost-effective way. By taking into account the local wave spectrum, it may be possible to achieve considerable dampening when the distance between the units is optimal, at the same time as the seabed substructure of each of the seabed units is configured with means for dampening of wave energy.

It should also be appreciated that the seabed unit of the seabed terminal is given a substantial height, also proving wind protection for a moored vessel.

The seabed unit of the seabed terminal may be designed to take very large vertical loads onto the seabed from large weights of liquids stored inside the storage module without any motions of the seabed terminal, typically up to 150,000 tonnes deadweight, corresponding to the capacity of a large tanker ship. Some of this capacity may be obtained by increasing the height of the storage volume while maintaining the horizontal footprint of the seabed terminal.

In addition, the present invention offers the possibility of establishing a seabed terminal on different soil conditions. The density, composition, consolidation and topography of seabed soil may vary significantly for one seabed location to another. This will have direct impact on the load bearing capacity of the seabed soil, and hence the possibility to find a predictable and reliable foundation solution for a seabed structure which shall be supported by the seabed. According to one embodiment, the based foundation may be in the form of a semi-submersible floating body, piled to the seabed. In this case the base substructure can be ballasted as a semi submersible structure and piled to the seabed through the base structure and possibly, but not necessary, the wall structure of the seabed substructure. It is important in these cases to have an efficient transfer of vertical structural forces, it is an advantage that the main structural beams of the base structure and the storage module has mirrored structural interfaces. This means that vertical forces from the bulkheads storage module are preferably transferred directly into the main structural beams of the base structure and into the piling structure and to the seabed. Tests has shown that the piled seabed substructure must tolerate and stand a weight of 100 000-120 000 tons.

An advantage of the present invention is that the piles may be terminated below the sea level, preferably but not necessary, closer to the sea bed. Moreover, the solution is not dependent on a configuration where the base structure is completely resting on and being directly supported by the seabed, more or less based on use of a gravity foundation. In such way, it may be possible to configure the floating module so that the weight and loads/forces acting on the floating module more or less mat be transferred to the base structure at the pile heads and its vicinity.

Another advantage is that the seabed substructure according to the present invention does not necessarily have to rest on the seabed, the weight, forces and loads being carried by the piles. Moreover, the seabed substructure is not dependent on use of skirts in order to resist tension, i.e. uplift of the structure caused for example by storm surge. Hence, the underside of the base structure does not need to have any load bearing contact with the seabed soil and the variable, operational and environmental loads of the sea terminal is taken up by the piles.

Sufficient bearing and supporting capacity may be obtained, depending on the load bearing capacity, achieved by means of the shear force between the pile surfaces and the corresponding wall surface of the grouted ducts or sleeves. Because of the grout in the annulus formed between the outer pile surface and the surface of the ducts or sleeves, required shear resistance is obtained to resist produced shear forces acting in this joint.

SHORT DESCRIPTION OF THE DRAWINGS

The device according to the invention can be explained in more detail in the following description with reference to the enclosed figures, wherein.

Figure 5:
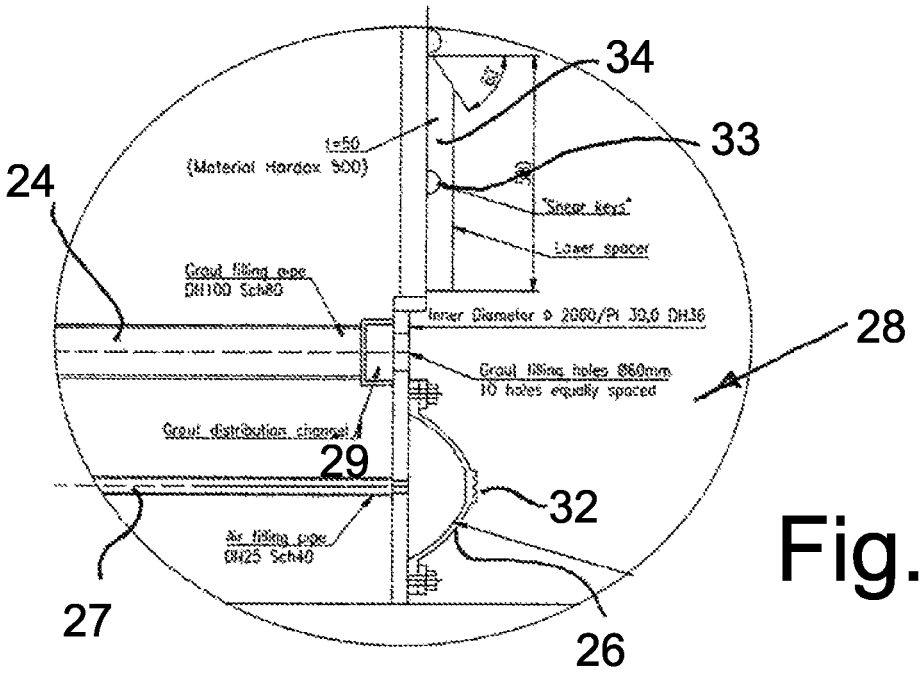
Figure 7:
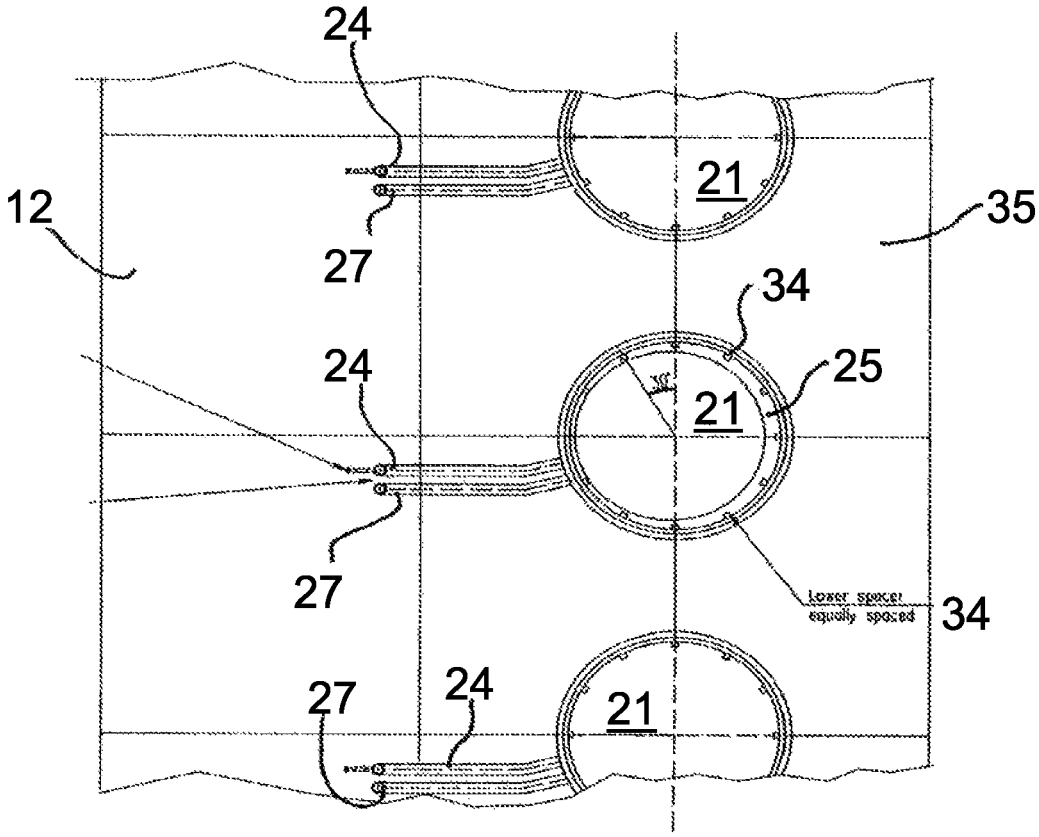
Figure 8:
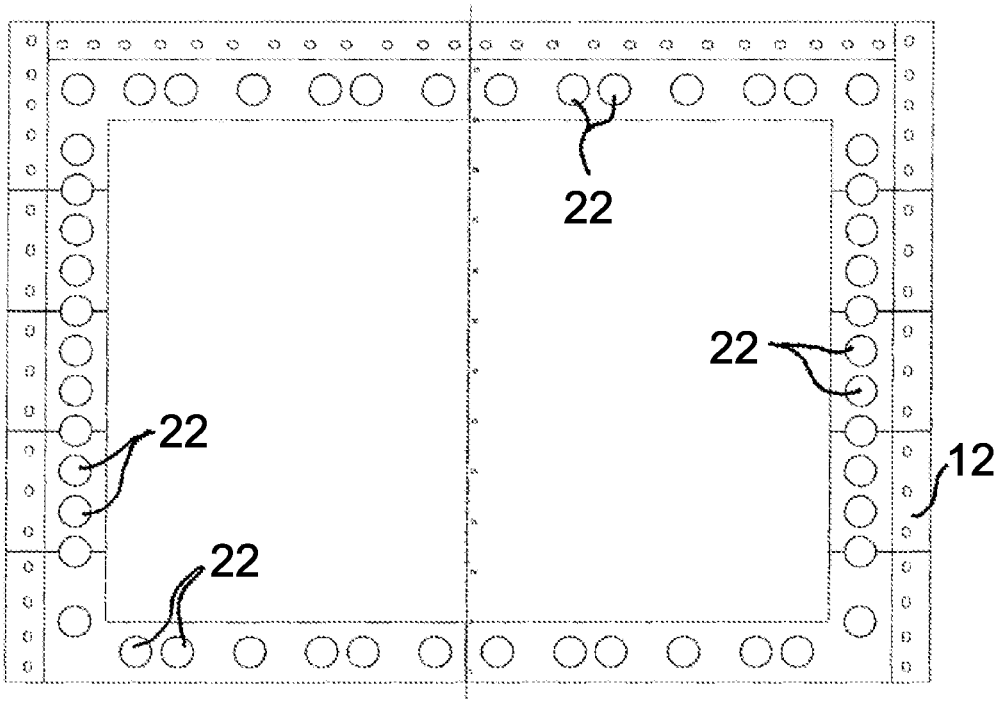
Figure 9:
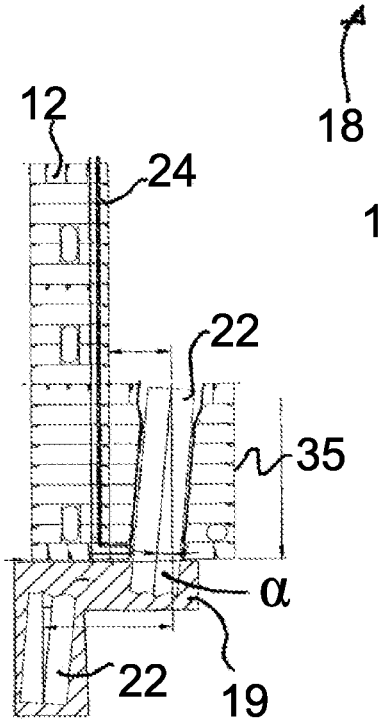
Figure 10:
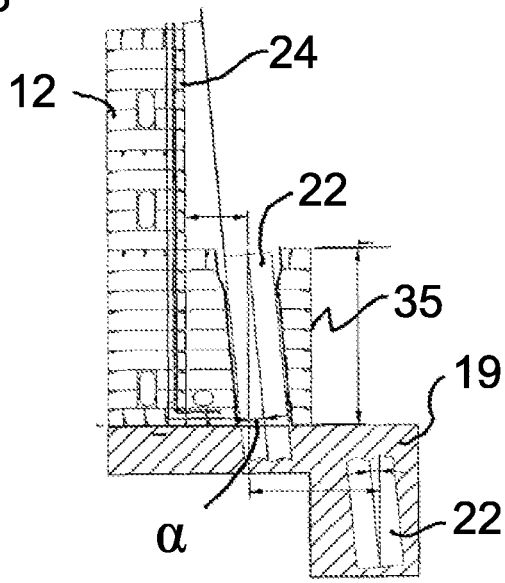
Figure 11:
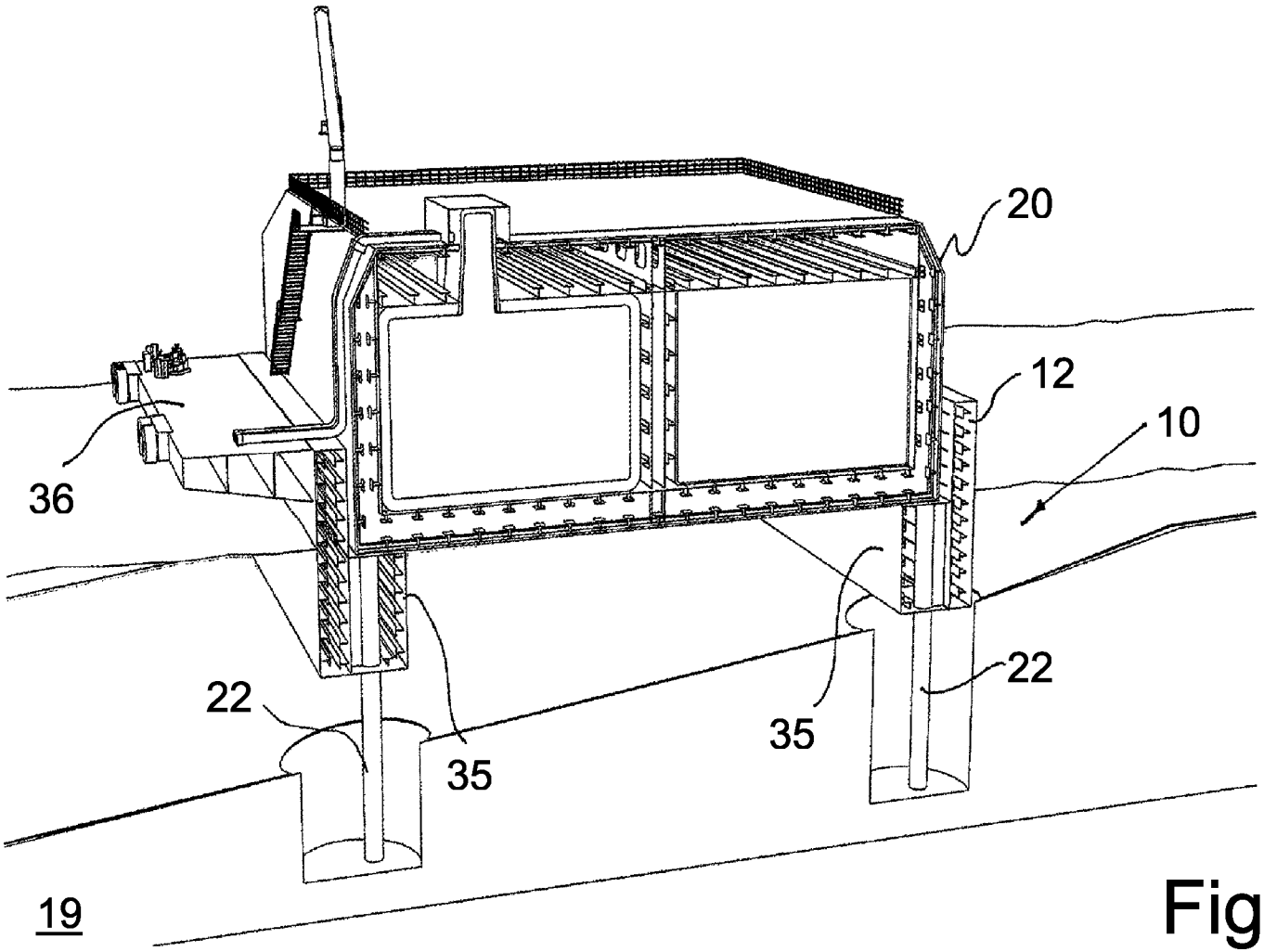
Figure 12:
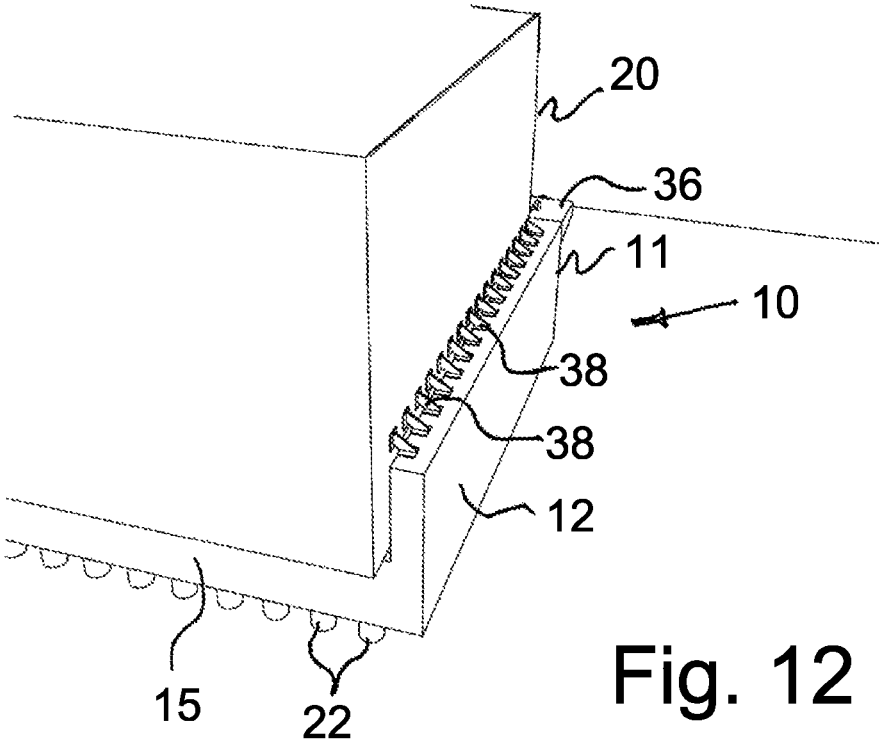

FIG. 5 showing schematically and in an enlarged scale a lower spacer and grout packer, arranged at the lower end of the duct intended to receive the pile, the pile being omitted;

FIG. 6 shows schematically and in an enlarged scale the upper spacer in the pile duct, where the pile is omitted;

FIG. 7 shows schematically a horizontal section through the line A-A in FIG. 5, showing the output end of the grout filling line;

FIG. 8 shows a second embodiment of the invention, provided with 50 pile sleeves arranged around the periphery area of the substructure;

FIG. 9 shows schematically a vertical section through a first embodiment of a side wall of the substructure according to the invention, indicating use of inclined pile sleeves and piles;

FIG. 10 shows schematically a vertical section through a second embodiment of a side wall of the substructure according to the invention, indicating use of inclined pile sleeves and piles, skewed in opposite direction compared to the embodiment disclosed in FIG. 9;

FIG. 11 shows schematically a view in perspective of another embodiment of the invention, showing the assembly placed on a sloped seabed; and FIG. 12 showing schematically in perspective one proposed solution for fixing the module to the seabed superstructure.

DETAILED DESCRIPTION OF THE DISCLOSED EMBODIMENTS

It should be noted that in the following description of the embodiments shown in the Figures, the same reference numbers are used for identical or similar structures and features.

Figure 1:
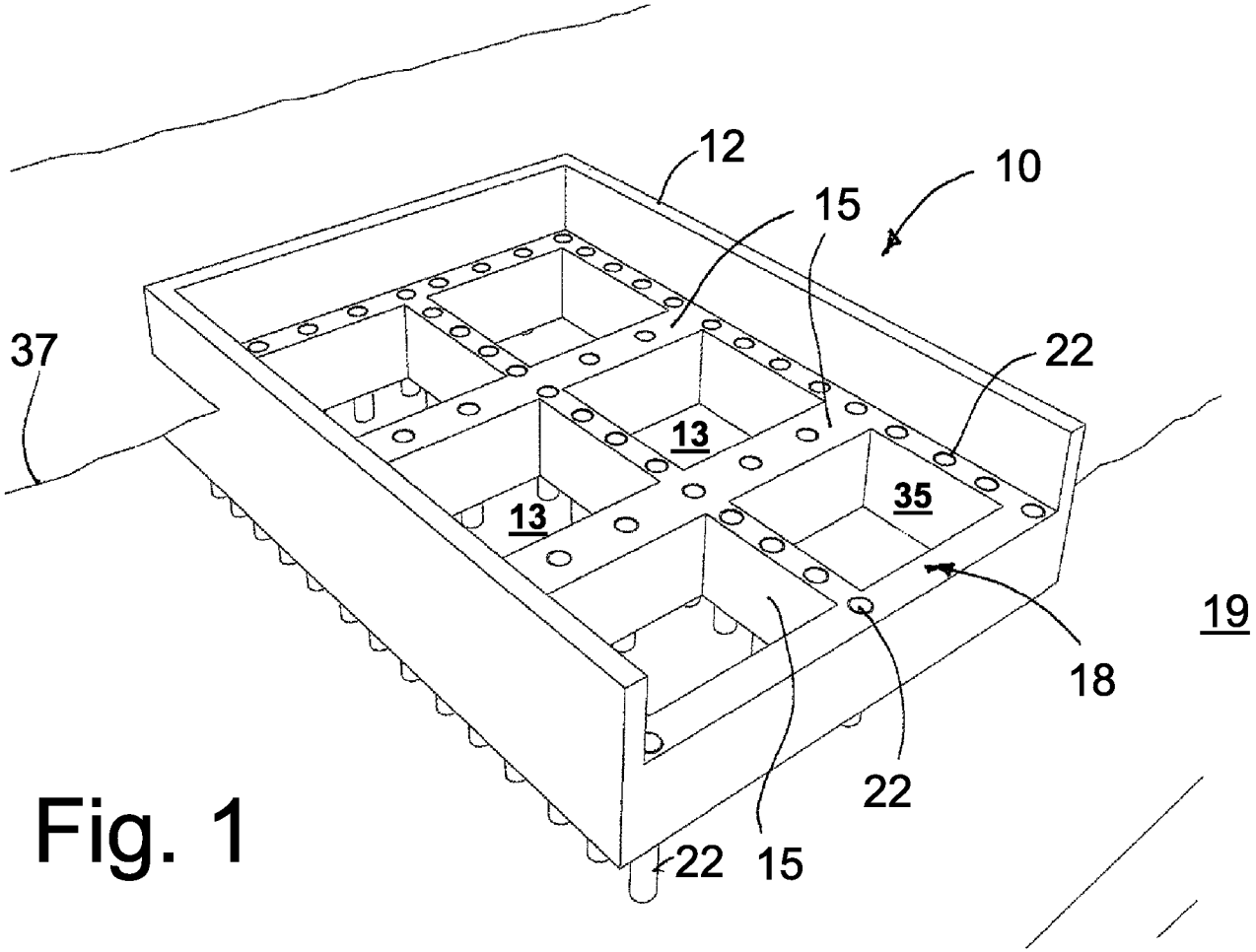
FIG. 1 shows schematically a view seen from above of a seabed substructure comprising a base structure, a wall structure and channels.

FIG. 1 shows schematically a view seen from above of an embodiment of the seabed substructure 10 according to the invention. The seabed substructure 10 comprises a base structure 11 with an upward extending wall structure 12 arranged along at least a part of the periphery of the base structure 11. The wall structure 12 being an integrated part of the base structure 11, together forming a seabed substructure 10. Both the base structure 11 and wall structure 12 are provided with buoyancy devices (not shown). Such buoyancy means may be in the form of tanks and compartments in the base structure 11 and in the upwards extending wall structure 12. The embodiment of the seabed substructure 10 shown in FIG. 1 is provided with a bottom beam structure 15 in longitudinal and transverse direction, forming upwards open compartments 13 in the base structure. The compartments 13 may be closed at the lower end by a bottom slab or the compartments may be open downwards, providing access to the piles 22 in case the base structure 11 is in an elevated position more or less above the seabed. Said longitudinal and transverse beams or walls 15 serve as a supporting, strengthen surface for supporting a floatable storage module to be floated in between the upwards extending wall structure 12, over the base structure and ballasted to rest on said surface. Upwards extending walls 12 extend along three sides of the base structure 12 and is provided with an opening 18 in the wall structure for introducing a floatable storage module 20 in over the base structure 12. The storage module 20 being removable arranged on top of the base structure 11 within the wall structure 12, together forming a seabed unit 30. At least one seabed unit 30 constitutes a seabed terminal 40.

The seabed substructure 10 are floating and has means for ballasting (not shown) and is intended to be placed on or just above the seabed 19, supported by a number of piles 22 or optionally, also resting on the seabed 19 due to gravity, fixed by means of piles. The upward extending wall structure 12 of the substructure 10 has perforations or ducts/sleeves through the wall structure for optional and/or additional piling, and also there are perforations in the base structure 11 for receipt of piles 22. The ducts and accessories for receiving the piles 22 will be described in further details below. A vessel 16 with machines and tools for piling are moored next to the wall structure 12 to perform the piling operations. As indicated in FIG. 1, piles 22 are arranged both in longitudinal and transverse direction along the foot of the three walls along the submerged front beam beneath the opening of the base structure 11, and along the internal walls 25 forming the upwards open compartments 13. In such way the entire footprint or at least parts of the footprint may be provided with piles for supporting the base structure 11 properly. The number of piles 22 used and their position, diameter and length depend on the weight to be supported and on the seabed soil condition.

An advantage according to the present invention is that the seabed substructure 10, constituting a part of the seabed unit 30 for floating modules, such as a floatable LNG storage unit or barge according to the invention, can be lowered down to installed offshore or near shore, be removed, be moved and be replaced to form new individual configurations as required using known techniques.

Figure 2:
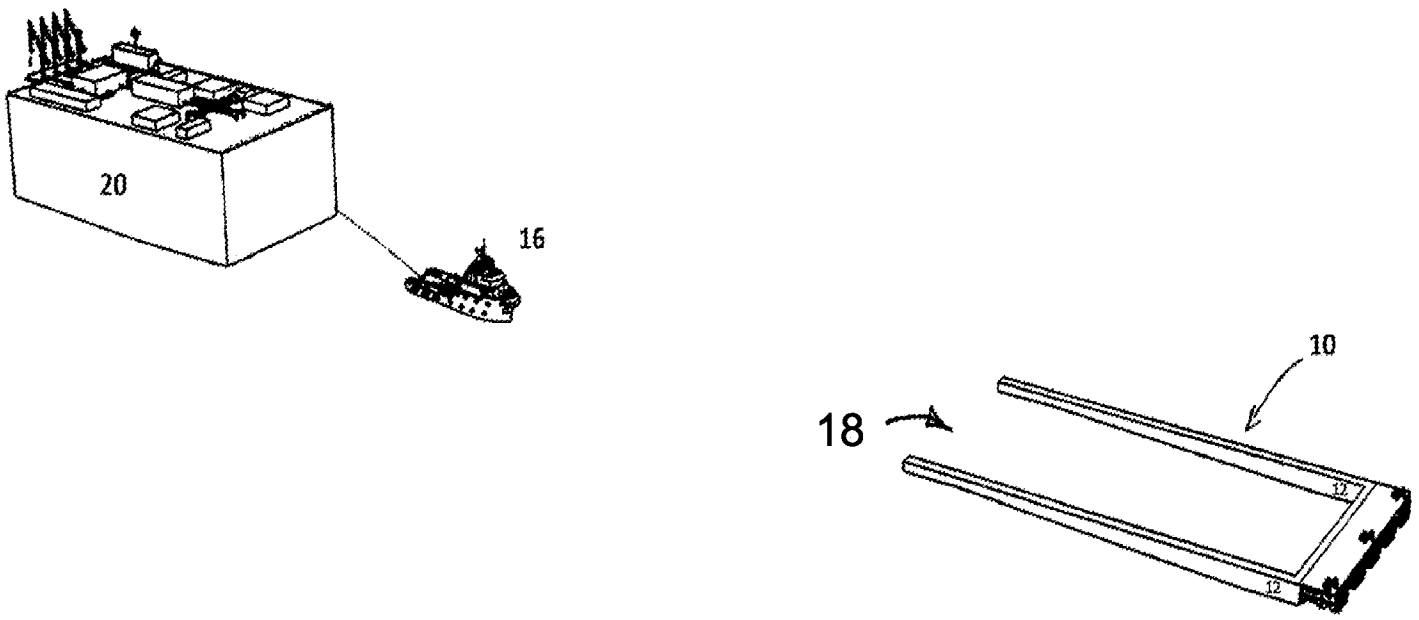
FIG. 2 shows schematically a view seen from above of the storage module towed to the site for mating with the seabed substructure.

FIG. 2 shows schematically a view seen in perspective from above, showing a storage module 20 being towed by a towing vessel 16 to the site to mate with the partly submerged, pre-installed seabed substructure 10. The storage module 20 is floating and has means for ballasting (not shown) and is preferably made from steel, although also other materials can also be used such as concrete. It should be appreciated that the storage module 20 according to the present invention also may be provided with means, such as loading systems, cranes, winches etc. on top of the storage module. When the storage module 20 arrives at the site, it is mated with the seabed substructure 10 placed at the seabed 19. During this mating operation, the floating module 20 is manoeuvred in through the opening 18 and in between the two parallel upwards extending side wall structures 12. The wall structure 12 of the seabed substructure 10 is extending up above the water surface 19 (as seen in FIG. 2) until the floating storage module 20 is guided on top of the base structure 11, within the wall structure 12. The module 20 is the ballasted so that module 20 rests stably on the base of the seabed substructure 10, forming a seabed an assembled unit 30.

An advantage according to the present invention is that the storage module 20 easily may be converted to store different oil related products and bunkering and/or serve different functions. The storage module 20 can be lowered on the seabed substructure 10, be removed, be moved and be replaced to form new individual configurations as required using known techniques.

Figure 3:
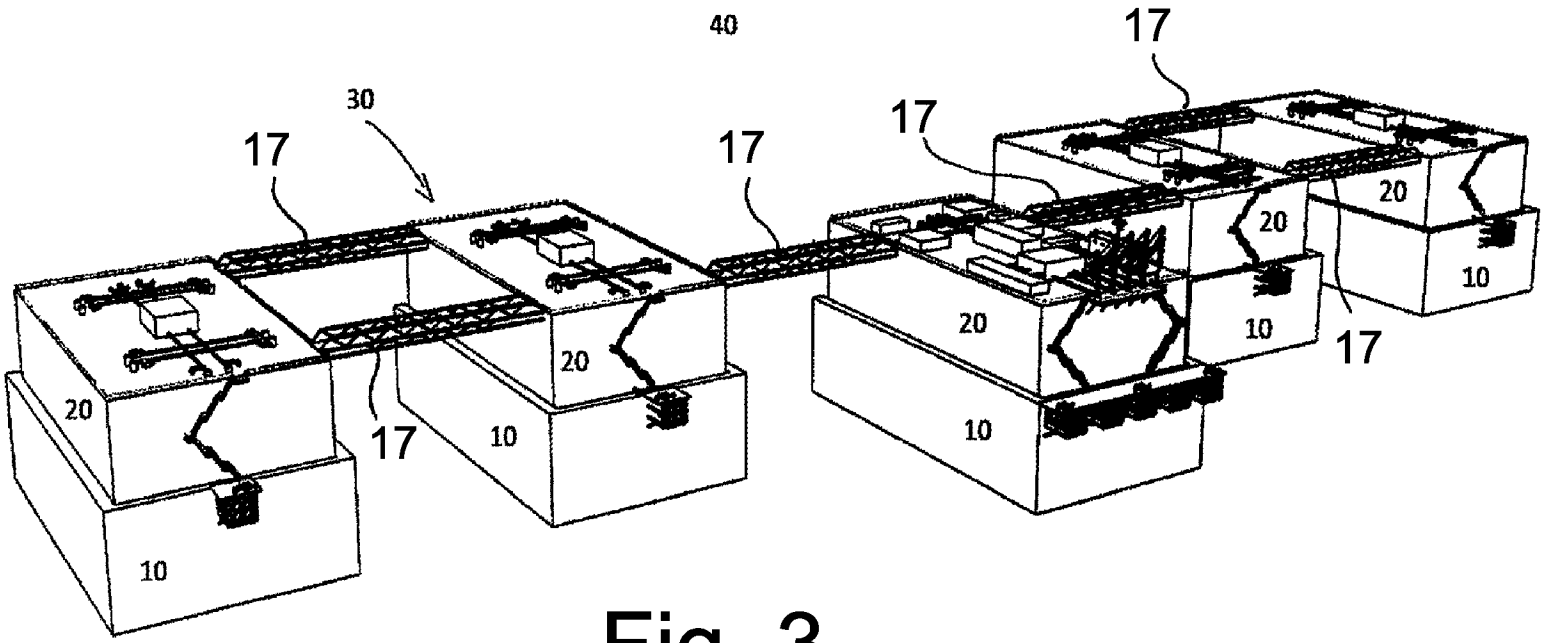
FIG. 3 shows schematically a view of five substructures mated with five respective storage modules together forming a shallow seabed terminal according to the invention.

FIG. 3 shows schematically a view in perspective, seen from above of a seabed terminal 40 comprising five seabed units or assemblies 30 placed in a pre-designed manner. It is an advantage of the present invention to arrange the seabed units or assemblies 30 in a way that waves are dampened efficiently by breaking and cancellation effects. The seabed units 30 according to the invention, forming the seabed terminal 40, are placed apart at a required distance. The distance between the units 30 is decided by the wave prevailing frequencies intended to be dampened and the frequencies allowed passing between the units 30. This distance can be calculated with known methods or be found by means of basic experiments. The orientation of the units or assemblies 30 is choses such as to establishing a required shelter, preventing waves coming from a direction more or less perpendicular to the longitudinal direction of the terminal 40. It should be appreciated that the mooring lines, mooring points etc. for mooring the vessel are not shown. The bridges, gangways etc. between the seabed units 10 are shown in FIG. 3.

Figure 4:
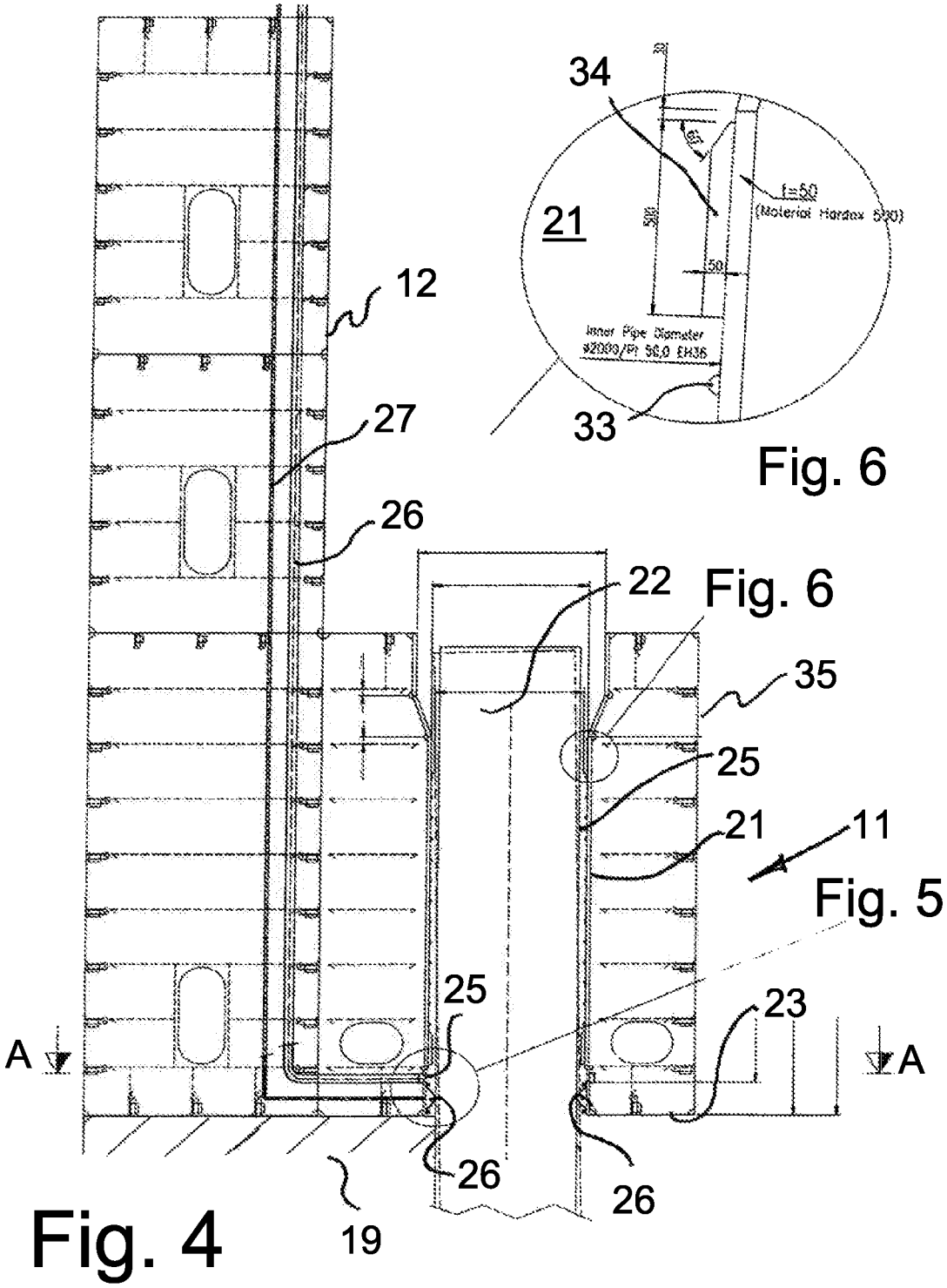
FIG. 4 shows schematically a vertical section through a side wall and a part of a bottom structure of the sea bed substructure, showing the duct for a pile and the upper end of the pile, both duct and pile being vertically arranged and with the substructure resting with its bottom part on the sea bed.

FIG. 4 shows schematically a vertical section through a side wall 12 and a part of a base structure 11 of the sea bed substructure, showing the ducts 21 for a pile 22 and the upper end of the pile 22, both duct 21 and pile 22 being vertically arranged and with the substructure 11 resting with its bottom plate 23 directly on the sea bed 19. Once a pile 22 is driven into its intended depth in the seabed 19 soil, a annulus 25 between the external surface of the pile 22 and the surface of the duct wall 21 is grouted by injecting grout from a grout producing plant (not shown) through a grout supply line 24. Said grout supply line 24 has its outlet 25 at the lower end of the duct 21. As a consequence of such outlet position, injected grout from the supply line 24 will be pressed upwards through the annulus 25 until the injected grout exits at the top of the duct 21. In order to prevent the grout from being forced downwards and oy of the annulus 25 and into the interface between the lower surface of the bottom plate 23 of the base structure 11 and the seabed 19, a ring formed stopping seal 26 is arranged, having contact surface against the outer surface of the pile 22 around its entire circumference. The stopping seal 26 may be in the form of a circular hose with cylindrical cross section, or as a semi-circular body, both free ends of the semi-circular body being sealing fixed to the surface of the duct 21, extending around the entire circumference of the duct 21, providing a fluid tight seal. The interior void of the seal 26 is fluid contact with a pressurized source (not shown) through a fluid supply line 27, securing supply of a pressurized fluid to the interior of the seal at the start-up of the grouting process, causing the stopping seal to expand, and possibly relieving the fluid pressure upon completed grouting process. The seal 26 will be described in larger details below in connection with FIG. 5.

As indicated in the FIG. 4, the upper entrance of the duct 21 may be provided with section having a lager diameter than the remaining part of the duct 21, having a downwards conical transition part in order to ease entering the lower end or bottom end of the pile 22 into the duct 21 at the initial phase of the piling process. Both at the top and the bottom of the duct 21, spacers 34 are arranged in order to secure a minimum distance between the outer surface of the pile 22 and the duct 21 wall, enabling proper grouting of the annulus around the pile 22. The entrance surface of the spacers may be a skewed to ease passage of the pile through the duct 22 past the spacers 34.

FIG. 5 showing schematically and in an enlarged scale a lower spacer and grout packer 28, arranged at the lower end of the duct 21, intended to receive the pile 22 (not shown). As shown in FIG. 5, a grout distribution channel 29 is arranged at the outlet end of the grout supply line 24, for example extending sideways in circumferentially direction of the duct 21. The channel 29 may extend around the entire circumference of the duct. Alternatively, several supply lines 24, each with an enlarged channel may be provided. Moreover, the embodiment shown of the annular seal or inflatable grout packing body 26 is in the form of a semi-cylindrical body of an inflatable material, fixed to the circumference surface of the duct 21 in a sealing manner, for example by means of bolts 31 or glued, or the like. The interior of the void of the seal or packer body 28 communicates with the end of the fluid line 27 for supply of a pressurized fluid to the void, At the extreme point or top of the packer body 28, the packer body is provided with circumferentially arranged fins 32, enhancing the sealing contact surface of the packer body 28.

As also indicated both in FIGS. 4 and 5, "shear keys" 33 are arranged on the wall of the duct 21 facing the pile 22 to be installed. The shear keys 33 are evenly distributed around the entire circumference of the duct 22 at different height.

FIG. 6 shows schematically and in an enlarged scale the upper end of the duct 22, disclosing use of spacers 34 arranged around the in exposed surface of the pile duct 21. The spacers 34 may be made of vertical metal strips fixed to the duct 21 wall, providing space between adjacent spacers to allow for complete filling of grout in the annulus 25.

FIG. 7 shows schematically a horizontal section through the line A-A shown in FIG. 5, showing a row of ducts 21 intended for receipt of piles 22 and the output end of the grout filling line 24 and the exit of the fluid supply line 27 to the interior of the stopping seal 26. The inner surface of the ducts is provided with vertical spacers, distanced apart around the circumference of the duct 21. The spacers 34 may have a limited width, extending vertically a certain limited length at the lower end of the duct 21. The section shown in the Figure discloses three ducts 21, of which a pile 22 is positioned in the duct 21. As shown an annulus 25 is established between the duct 21 wall and the pile 22. Because of the spacers 34 a void is established around the entire annulus 25.

FIG. 8 shows a second embodiment of the base structure 11, provided vertical walls 12 arranged on three sides and intended to extend up above sea level 37 when installed on the seabed 19. Moreover, the disclosed embodiment is provided with an open front without a vertical wall intended to extend up above sea surface, leaving an opening 18 for entry of the floating module 20 to be towed in and over the base structure 11. The base structure 11 is provided with fifty pile ducts 22 arranged around the periphery area of the substructure. As indicated, the ducts 22 are arranged along all four sides of the seabed substructure 10.

FIGS. 9 and 10 show schematically a vertical section through an embodiment of a side wall 12 of the substructure 11 according to the invention, indicating use of inclined pile sleeves or ducts 21 and piles 22 installed and driven into the seabed 19. As indicated the sideways displacement of the lower end of the pile in the seabed. The sideways displacement of the pile 22 depends on the angle of inclination a and the length of the pile 22. As indicated in FIGS. 9 and 10, the upper end of the pile 22 is fixed to a sideways extending bottom slab 35 forming an integral part of the vertical wall 12 and extending along at least three sides the substructure 11, possibly also the forth side, i.e. a transverse beam, interconnecting the two free ends of the substructure 11 at its bottom part 11.

FIG. 11 shows schematically a view in perspective of another embodiment of the invention, showing the assembly 10,20 placed on a sloped seabed 19. The embodiment shown in FIG. 11 has a base structure 11 without the bottom beam structure 15. Moreover, there are no structures in the form of the sea bed structure interconnecting the two sidewalls 12. As shown the floating module 20 is resting on the bottom slab 35 extending laterally out from the wall structure 12, such bottom slab 35 extending preferably along the three walls 12 at their lower ends. Moreover, as disclosed the pile heads are terminated below the sea level 37, more or less coinciding with the upper surface of the bottom slab 35.

The seabed substructure 10 and the storage module 20 may be constructed at the harbour site, build at a remote construction site, towed and placed at site. The seabed units 30 and the seabed terminal 40 are formed according to the local environmental conditions such as depth of water, type of ocean bottom, wave formations and where possible, negative effects from environmental forces such as waves, wind and current are minimised. Dependent on desired mooring direction and position for the LNG ship, the seabed substructures are placed on the ocean bottom in a desired configuration such that the desired loading conditions for the LNG ship are the best possible according to operative and safety considerations.

According to the embodiment disclosed in FIG. 11, only the one side or part of the one side is in contact with the seabed, while the remaining parts are only supported by the files 22. It should be appreciated that the entire bottom of the seabed structure, with or without the base slab 35, also may rest on the seabed, or the seabed structure may be positioned such that none part of the base structure, with or without the base slab 35 is in contact with the seabed, all forces appearing being taken by the piles.

FIG. 12 shows schematically in perspective a view of floatable structure 20 in a position where the floatable structure is fixed to the base structure 11 by means of a number of fixation devices 38, each in the form of a steel plate intended to be fixed to the surface of the floating structure 20 and a corresponding steel plate intended to be fixed to the top surface of the vertical walls 12 of the base structure 11. A vertical shear plate is fixed to both plates the vertical shear plate being arranged perpendicular with respect to said two plates on the base structure 11 and floating structure 20 respectively and also vertical with respect to the surface of the two structures 11,20. If the base structure 11 and the wall are made of steel, the two plates are welded to the said structures. If the two structures are made of concrete, the steel plates are welded to steel plates embedded in the respective concrete walls. Such configuration of the fixation devices provides access to the fixation devices for maintenance etc.

According to one embodiment of the invention, sixty one piles having a diameter of 2.2 m and e length of 50 m are required in order to sustain the maximum environmental design loads. These piles are inclined with a 5° angle from the vertical in order to reduce the ground effect. In this context, it should be appreciated that where piles supporting the base structure are positioned close to each other a simple and conservative approach mat be to reduce the oiling capacity to approximately ⅔ of a single pile capacity, when considering load cases.

It should be appreciated that the piles may extend vertically down into the seabed or, they may be arranged inclined with respect to the vertical, either in same direction, inwards or outwards, or a combination of the same.

The seabed substructure may also be provided with a harbour section 36, configured for allowing vessels to moor alongside the harbour section 36. The construction material may be concrete or steel or a combination of both. The harbour section 36 is fixed to and built into at least one of the vertically extending walls 12, so that all forces and loads is taken by the seabed substructure 10 and transferred to the piles. Moreover, the harbour section may preferably be arranged on the opposite side(s) of the prevailing direction of wind and/or waves, providing a shelter for the vessel(s) moored along the harbour section 36.

In addition to or in lieu of use of gravity for supporting the floating structure 20 to the seabed structure 11, one way of fixing the floatable module 29 to the seabed structure may be to provide the floatable structure with a number of fixing devices configured in such way that fixing points between the floatable structure and the seabed structure are above sea level 37, preferably arranged on top of the vertically extending walls. In such case the fixing points may easily be accessed for inspection and maintenance and possibly also for releasing the floatable unit from the seabed structure. Although the embodiments shown are provided with laterally extending beams extending into the U-shaped base structure, it should be appreciated that such laterally extending beams also may extend outwards from the vertical walls, allowing for corresponding types of piling also on the opposite side of the vertical walls.

The invention claimed is:

1. A shallow water seabed terminal for storing and loading or unloading hydrocarbons, said seabed terminal comprising a removable floatable module, and a removable seabed substructure configured to be supported by a seabed, the floatable module being releasably fixed to the seabed substructure so that a harbour terminal is formed, the seabed substructure including a base structure provided with buoyancy devices, a wall structure extending upwardly from the base structure and arranged along at least a part of a periphery of the base structure, the base structure being provided with an opening in the wall structure for allowing the floatable module to be berthed in and supported by the seabed substructure, wherein the base structure is provided with a submerged beam structure extending along the circumference of the base structure and extending laterally out from the wall structure and configured to support the floatable module, the submerged beam structure being provided with sleeves or ducts extending through the submerged beam structure and being configured to receive piles to be driven down into a soil of the seabed, wherein an upper end of each pile is terminated and rigidly locked or anchored in the submerged beam structure ensuring that the weight of the floatable module when berthed is transferred directly through the submerged beam structure and through the piles into a deeper layer of the seabed soil.

2. The seabed terminal according to claim 1, wherein heads of the piles are configured to be terminated below sea level.

3. The seabed terminal according to claim 1, wherein the sleeves or ducts form an angle $\alpha$ with the vertical axis, securing the piles in an inclined position when piled.

4. The seabed terminal according to claim 1, wherein an underside of the base structure has no load bearing contact with the soil of the seabed and variable, operational and environmental loads of the seabed terminal are taken up by the piles.

5. The seabed terminal according to claim 1, wherein the base structure is a jacket frame structure.

6. The seabed terminal according to claim 1, wherein the wall structure is an integrated part of the base structure.

7. The seabed terminal according to claim 1, wherein the seabed substructure is ballasted.

8. The seabed terminal according to claim 1, wherein at least parts of the wall structure extend above a water surface.

9. The seabed terminal according to claim 1, wherein the seabed substructure includes piling of the wall structure extending from a top of the wall structure through a bottom of the wall structure.

10. The seabed terminal according to claim 1, wherein the opening in the wall structure for introducing the floatable module is closable with a closing mechanism forming a closed wall structure at the periphery of the base structure.

11. The seabed terminal according to claim 1, wherein the sleeves or ducts are provided with sealing devices at a lower end, preventing grout to escape downwardly.

12. The seabed terminal according to claim 1, wherein an inner surface of the sleeves or ducts is provided with spacers, configured to prevent the piles from coming into direct contact with the inner surface of the sleeves or ducts, thereby establishing an annulus for filling of grout.

13. The seabed terminal according to claim 1, wherein an inner surface of the sleeves or ducts is provided with a number of shear providing devices, securing proper shear and adhesion between the inner surface of the sleeves or ducts and an external surface of the pile.

14. The seabed terminal according to claim 1, wherein the base structure and the floatable module are divided into the same number of bulkheads and vertical walls of the bulkheads form a structural beam so that vertical forces of the storage module are transferred directly into the structural beam of the base structure.

15. The seabed terminal according to claim 1, wherein the floatable module is locked to the base structure by one of a mechanical locking device and shear force plates welded to the seabed substructure.

16. The seabed terminal according to claim 2, wherein the sleeves or ducts form an angle $\alpha$ with the vertical axis, securing the piles in an inclined position when piled.

17. The seabed terminal according to claim 2, wherein an underside of the base structure has no load bearing contact with the soil of the seabed and variable, operational and environmental loads of the seabed terminal are taken up by the piles.

18. The seabed terminal according to claim 3, wherein the wall structure is an integrated part of the base structure.

19. The seabed terminal according to claim 4, wherein the wall structure is an integrated part of the base structure.

20. The seabed terminal according to claim 17, wherein the wall structure is an integrated part of the base structure.

21. The seabed terminal according to claim 1, wherein the hydrocarbons comprise at least one of LNG, oil, and gas.

22. The seabed terminal according to claim 2, wherein the heads of the piles are configured to be flush with an upper surface of the submerged beam structure.

23. The seabed terminal according to claim 12, wherein the spacers are provided at an upper and lower end of the sleeves or ducts.

24. The seabed terminal according to claim 1, wherein the floatable module is supported above the sea level by providing the floatable module with fixation devices extending sideways out from the floatable module and configured to be fixed to the top surface of the walls, all above the sea level.

25. The seabed terminal according to claim 1, wherein the sleeves or ducts form an angle $\alpha$ with the vertical axis, securing the piles in an inclined position when piled, wherein an underside of the base structure has no load bearing contact with the soil of the seabed and variable, operational and environmental loads of the seabed terminal are taken up by the piles, wherein the seabed substructure includes piling of the wall structure extending from a top of the wall structure through a bottom of the wall structure, wherein the sleeves or ducts are provided with sealing devices at a lower end, preventing grout to escape downwardly and wherein the floatable module is supported above the sea level by providing the floatable module with fixation devices extending sideways out from the floatable module and configured to be fixed to the top surface of the walls, all above the sea level.

26. The seabed terminal according to claim 1, further comprising a grid system, wherein the upper end of each pile is terminated and rigidly locked or anchored in at least one of the submerged beam structure and the grid system below sea level, ensuring that the weight of the floatable module when berthed is transferred directly through the at least one of the submerged beam structure and the grid system through the piles into the deeper layer of the seabed soil.

* * * * *